US005579015A

United States Patent [19]

Collignon

[11] Patent Number: 5,579,015

[45] Date of Patent: Nov. 26, 1996

[54] ELECTRONIC SWEEP DEVICE WITH ACTIVE LENS AND INTEGRATED LIGHT SOURCE

[75] Inventor: Gerard Collignon, Les Ulis, France

[73] Assignee: Societe d'Etude du Radant, Les Ulis Cedex, France

[21] Appl. No.: 788,616

[22] Filed: Jul. 1, 1985

[30] Foreign Application Priority Data

Jul. 12, 1984 [FR] France ..... 84 11066

[51] Int. Cl.[6] ..... H01Q 3/22

[52] U.S. Cl. ..... 342/375; 342/376; 343/754; 343/756

[58] Field of Search ..... 343/754, 756, 343/909; 342/375, 376

[56] References Cited

U.S. PATENT DOCUMENTS

| | | | |
|---|---|---|---|
| 4,150,382 | 4/1979 | King | 343/754 |
| 4,268,831 | 5/1981 | Velentino et al. | 343/754 |
| 4,297,708 | 10/1981 | Vidal | 343/754 |
| 4,320,404 | 3/1982 | Chekroun | 343/754 X |
| 4,413,263 | 11/1983 | Amitay et al. | 343/756 |
| 4,447,815 | 5/1984 | Chekroun et al. | 343/754 |
| 4,552,151 | 11/1985 | Bolomey et al. | 343/754 X |

OTHER PUBLICATIONS

Skolnik, "Introduction to Radar Systems", McGraw–Hill, 1980, pp. 298–305.

*Primary Examiner*—Mark Hellner
*Attorney, Agent, or Firm*—Pollock, Vande Sande & Priddy

[57] ABSTRACT

The invention pertains to an electronic sweep device with integrated active lens and light source.

The device includes a bundling of superimposed channels C which are separated by thin metal planes P that include, in front of a metal short-circuit plane (10), illumination organs (S) and phase displacement organs (B).

The invention makes it possible to create a compact electronic sweep device which eliminates the parasitic reflection phenomena between illuminator and lens for the purpose of controlling a hyperfrequency beam.

10 Claims, 6 Drawing Sheets

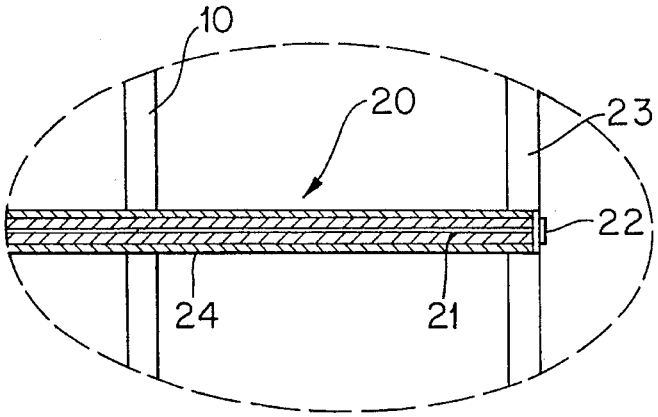
FIG. 8
FIG. 9
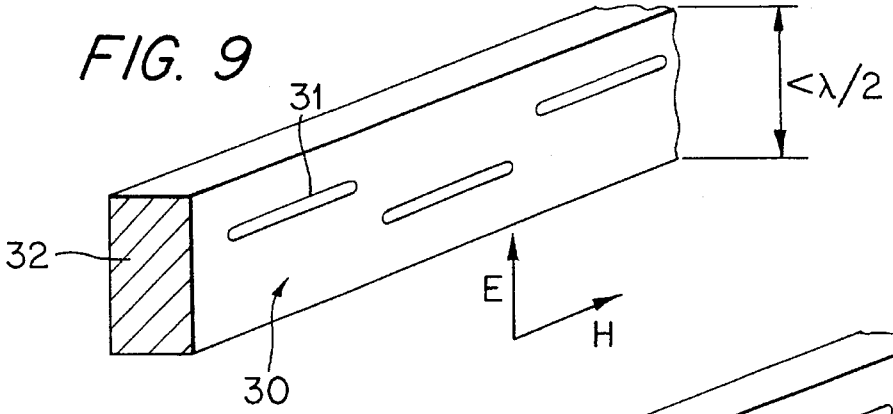
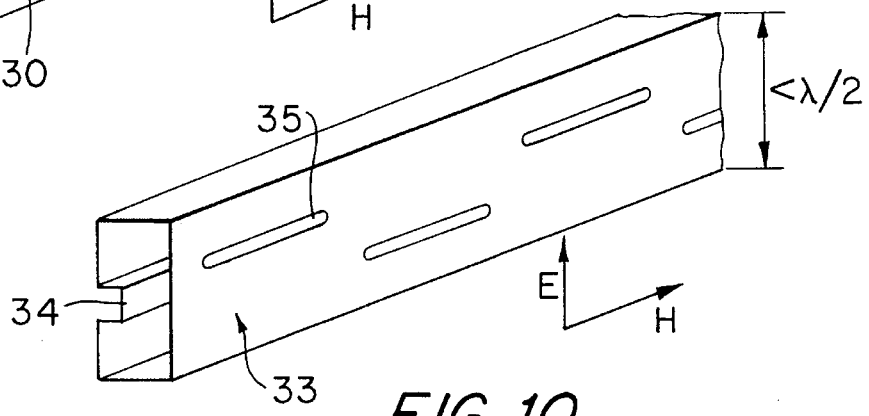
FIG. 10

ELECTRONIC SWEEP DEVICE WITH ACTIVE LENS AND INTEGRATED LIGHT SOURCE

This invention pertains to an electronic sweep device with an integrated active lens and source for the purpose of controlling a hyperfrequency beam.

In an electronic sweep antenna comprised of an integrated and an active lens, some well known multiple reflection phenomena might appear.

According to the kind of source in use, those reflections can produce different effects, for instance:

—an increase in scattered radiation for a reflector antenna,

—the emergence of a secondary lobe for a plate antenna.

The amplitude of those disturbances mainly depends on the reflection coefficient of the source for incidences outside the main lobe. Even with a network antenna known as "magical" (or achieved through adapted power dividers), the reflection coefficient depends on couplings between radiating elements. Therefore it is not possible to cancel it in all incidences.

The purpose of the invention is to prevent those parasitic phenomena by eliminating the coupling coefficients of the source and of the input side of the lens, through the insertion of radiating elements from the source inside the lens.

Practically speaking, the electronic sweep device with integrated active lens and source in conformance with the invention is characterized in that it includes:

—a bundling of superimposed channels separated one from the other by thin metallic planes which are directed more or less perpendicularly to the electric field $\vec{E}$ of the processed beam, —a metallic short-circuit plane which closes said channels on one side, at the rear, and that connects all of said separation planes to the ground, —a source which is positioned inside each channel close to said metallic short-circuit plane, —organs for phase displacements in increments that are placed inside said channels, one behind the other, —radioelectric means which are associated with each source in order to transmit and receive, —electronic control means which are associated with each phase displacement organ in order to control each organ in one or the other of the two states, active or passive.

The kind of active lens which is used is advantageously of the type that is described in the French patent No. 79 27873 of applicant dated Nov. 13, 1979. Inside such a lens where the width of the channels is close to a half wave length, a source which is particularly well adapted is of the "snake line" type, each source being comprised practically of a printed metallic circuit on a support bar made of dielectric material, the width of which is roughly equal to that of the channels inside which the bar is inserted.

The phase displacement organs are advantageously comprised of support bars made of dielectric material, the width of which are roughly equal to that of channels inside which the bar is inserted, said bars bearing segments of conductive metal wires, printed on them, that are in a direction perpendicular to said separation planes when the bars are in place, said segments being gathered in series by metal tracks which are oriented perpendicular to said segments, and distributed according to two parallel lines that are spaced so that, in the vicinity of bar sections, we go from one segment to the next by traversing a metal track from one of the lines, then the other, the length of the tracks being roughly equal to double the spacing between said segments, each segment bearing at least one diode, and all the diodes being assembled in the same direction according to the constant electric path which describes in series the tracks and segments of a bar.

Thus, we can achieve electronic sweep devices with integrated active lens and source from a very small number of identical and repetitive elements of which the assembly into a single unit can be very easily achieved.

The invention, its purpose, and its implementation will appear more clearly with the description that follows in reference to the attached drawings where:

FIG. 1 schematically shows in a cut away view the assembly of an electronic sweep device with integrated lens and light source in conformance with the invention.

FIG. 2 schematically shows a channel from that device.

FIG. 3 schematically shows at a larger scale in a perspective view how the electric branches are achieved for the electronic control of phase displacement organs.

FIGS. 4 and 5 are two equivalent diagrams of electronic elements which are part of the make-up of phase displacement organs according to two different states of controlled diodes.

FIG. 6 schematically shows in a cut away section how the snake line type illuminator (source) element is assembled at the bottom of each channel.

FIG. 8 shows at a larger scale the delineated detail VIII of FIG. 6.

FIGS. 9 and 10 schematically show in a perspective view source elements which can be used instead of the snake line type illuminators which were described previously.

Figure 11:
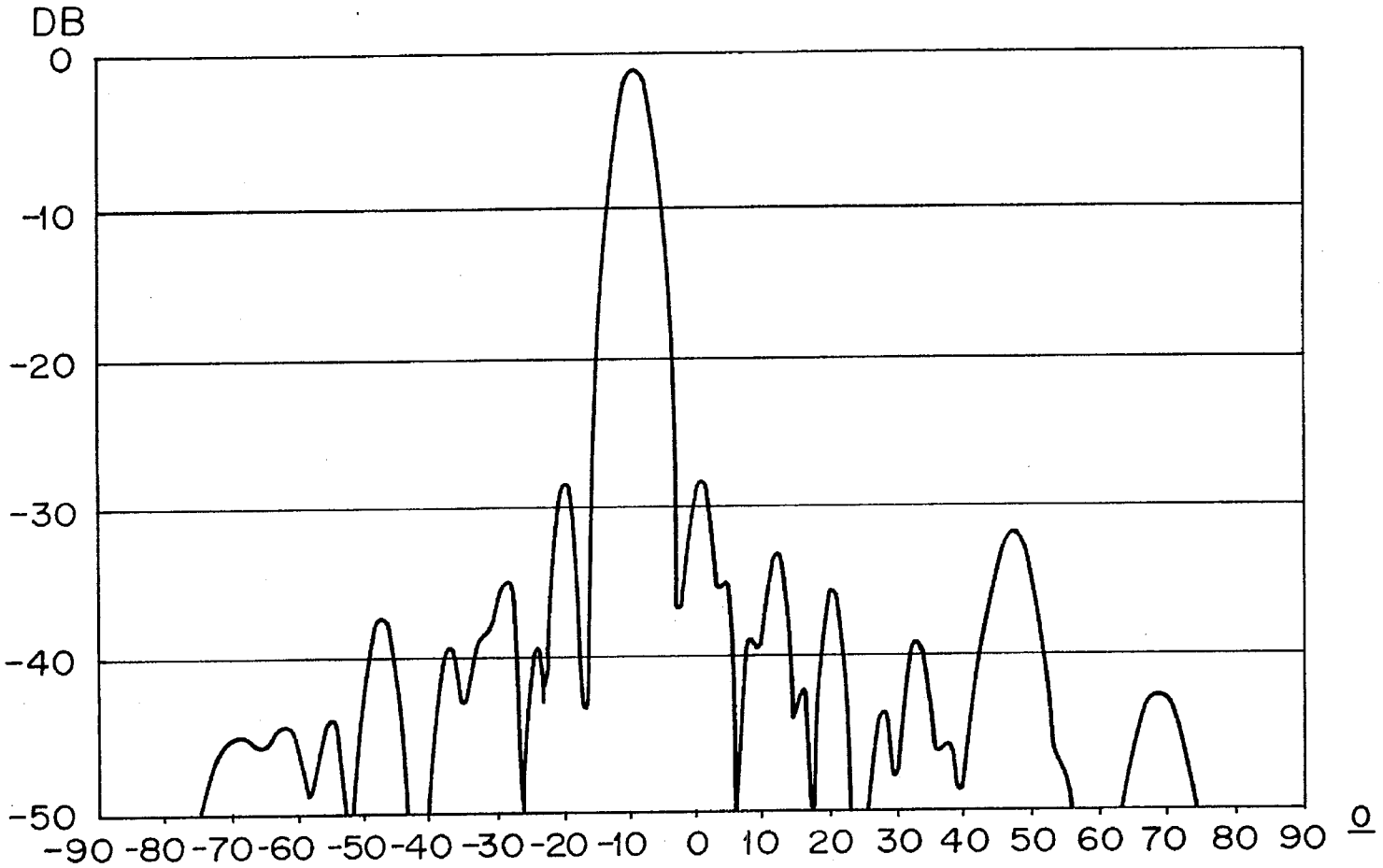

FIG. 11 shows in the plane of vector $\vec{E}$ a total pattern obtained for a controlled backing-off of the beam by about 10 degrees.

Figure 1:
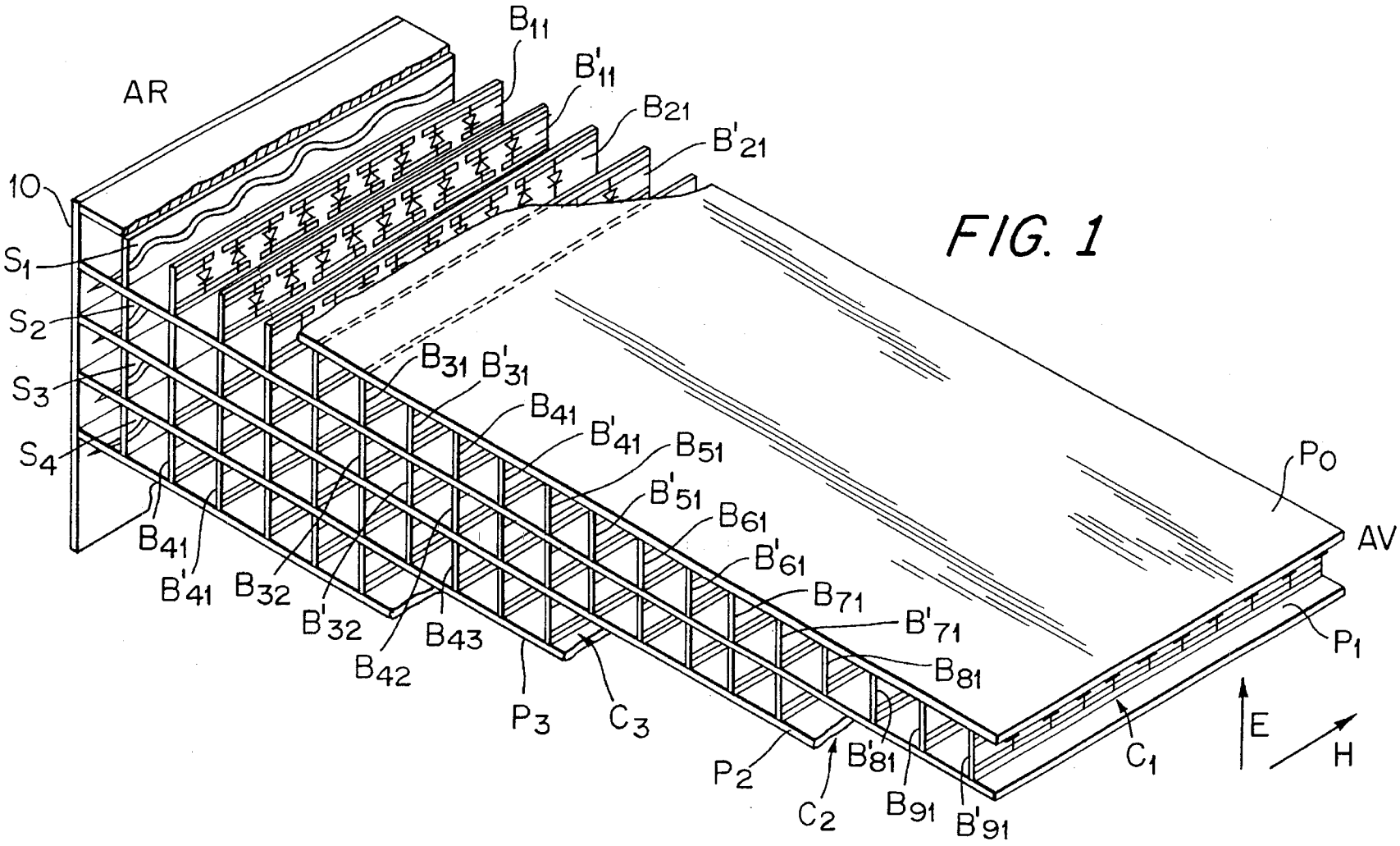
Figure 12:
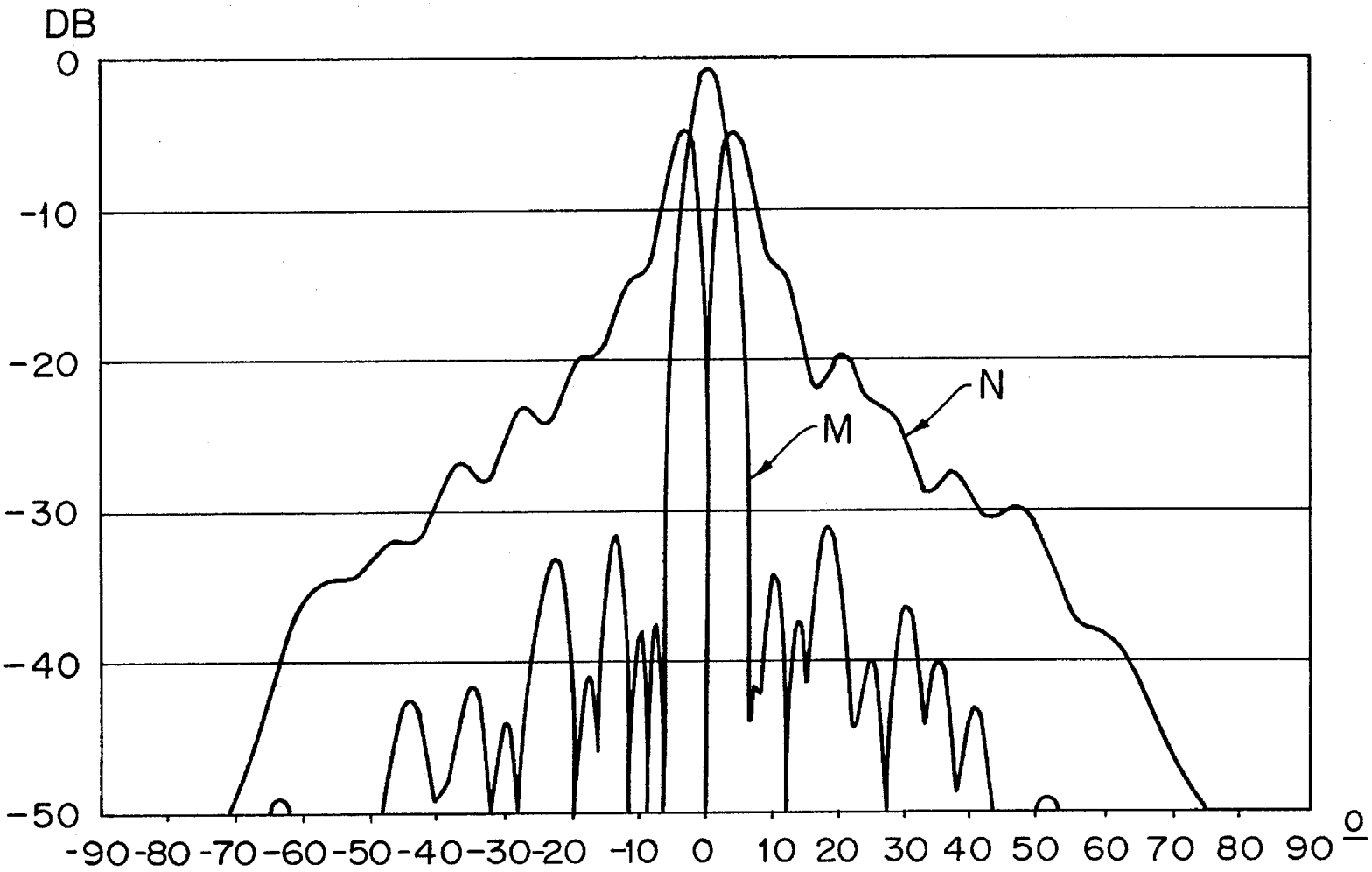

FIG. 12 shows in the H plane a total pattern and a difference pattern obtained from a general type of device as illustrated in FIG. 1 and lit by sources of the snake line type which are supplied through the center.

Figure 2:
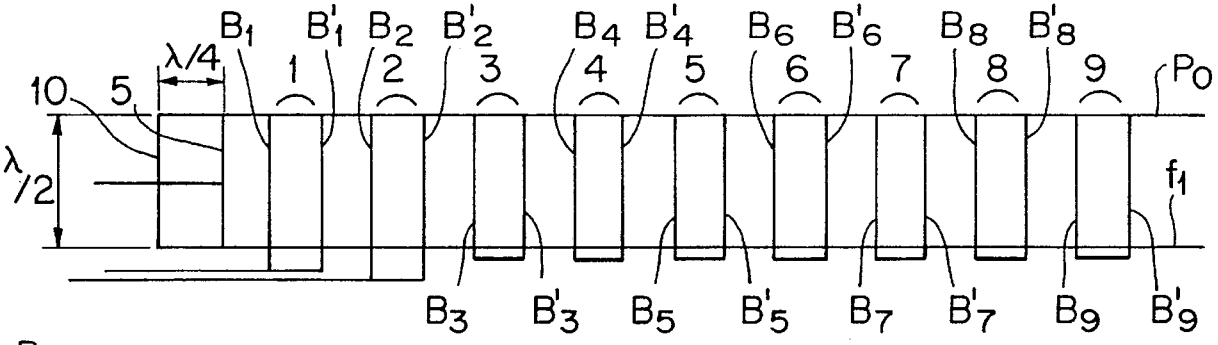
Figure 3:
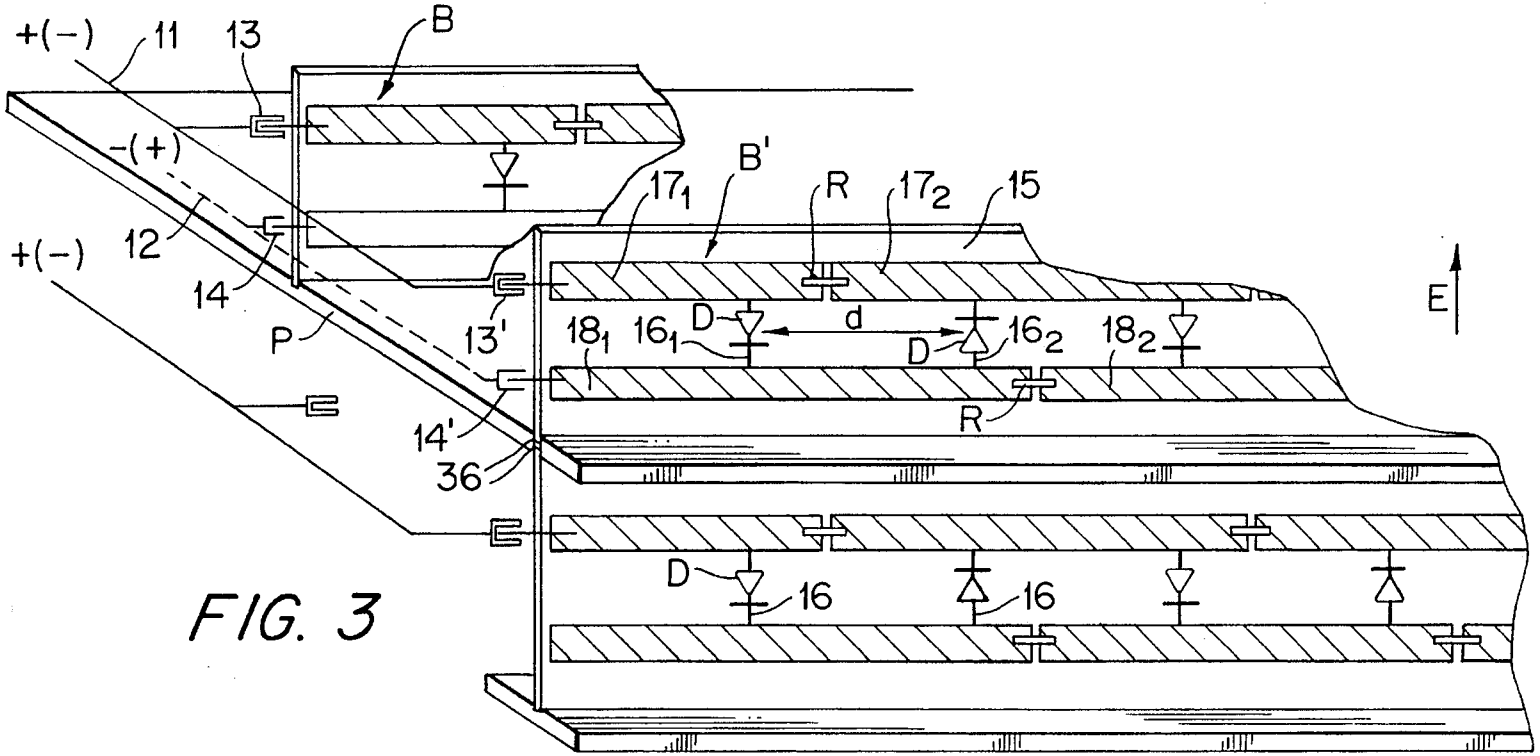

First of all, we will describe the assembly of a device in conformance with the invention by referring especially to FIGS. 1 through 3.

The device in conformance with the invention a hyperfrequency lens which makes it possible to control the backing-off of a hyperfrequency wave beam in the plane that is parallel to the electric field vector $\vec{E}$, and a lens of which the general assembly is of the type described in the above mentioned patent 79 27873. This lens includes a plurality of superimposed channels $C_1$, $C_2$, $C_3$ . . . thus forming a bundling in the plane which is perpendicular to the electric field vector $\vec{E}$. The channels are separated from one another by thin metal planes P0, $P_1$, $P_2$, $P_3$ . . . The directional control of the lens is obtained with phase displacement organs. These phase displacement organs comprise, in each channel, bars B. The bars B are positioned one behind the other, and parallel to the direction of the electric field vector $\vec{H}$. The assembly and control of the bars B will be described below.

The device also includes, in its rear part, and referred to as AR, short-circuit metal plane 10 which closes all the channels C on that side. The channels remaining obviously open at their front part AV in order to transmit and receive the beam.

Close to the short-circuit plane 10 and to the rear of all the phase displacement organs which are comprised of the bars B there is arranged in each channel a source element or illuminator S which makes it possible to illuminate each channel through the arrangement of the various phase displacement organs, made up of the bars B, and placed one behind the other.

In the assembly example illustrated in FIG. 1, the device includes 30 channels bundled one on top of the other, of which the only channel $C_1$ was depicted in whole. All the channels are identical.

Each channel is made up (see figures and 2) of the positioning of the following successive elements:

—at a distance of a quarter of a wave length in front of the short-circuit plane 10, a source element S of the snake line type, —in front of that source element, nine phase displacement organs referred to as 1 through 9 (FIG. 2) each comprised of two connected bars B, B'.

The first phase displacement organs, which are all identical, make it possible to obtain phase displacements of 45 degrees. The 8th and 9th cells make it possible to obtain phase displacements of 22.5 degrees and 11.25 degrees respectively. Thus it is possible, by selecting the active or passive state of each cell and the number of cells which are controlled in those states to obtain phase displacements ranging from 0 to 360 degrees in increments of 11.25 degrees. In FIG. 1, in order to facilitate the reading of position of the various bars, each bar B was indexed with a two-digit number, of which the first digit corresponds to the row of the phase displacement under consideration (1 through 9) and the second digit corresponds to the level of the channel under consideration (from 1 to 30 in the event of a bundling of 30 channels). Furthermore, in each pair of bars that comprises an individual cell, we differentiated among those two bars by assigning them or not a superior index (').

By referring to FIG. 3, we indicated how the control of each phase displacement cell comprised of a pair of bars B, B'. could be performed with control wires 11, 12. The wires 11, 12 are brought together for instance on a segment of the bundling parallel to the plane P with connectors, for instance which can be plugged in like 13, 13', 14, 14' onto a segment of bars.

Figure 4:
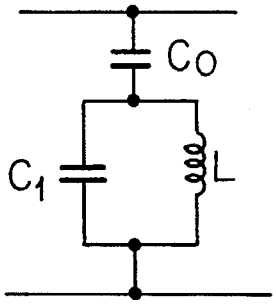
Figure 5:
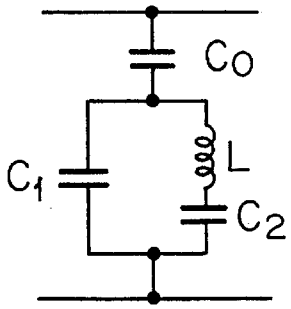

By referring to FIGS. 4 and 5, we will describe a preferred practical way of achieving phase displacement bars.

The bar is comprised (see FIG. 3) of a support 15 made of dielectric material with a small loss tangent like teflon glass, for instance with a thickness of 0.4 mm. Each bar is roughly the width of the channel inside which it is inserted by being engaged like a drawer inside pick-up grooves such as those indicated at 36 and set up in the metal channel separation planes P. On that support, there are arranged at a d distance, preferrably smaller than the half wave length of the conductive metal wires 16 which each carry a diode D for instance of the P I N type. The wire segments 16 are gathered in series by metal tracks 17, 18, and directed perpendicular to said segments and distributed according to two parallel lines which are spaced and close to the segments of the supports 15 for bars B. Clearly depicted in FIG. 3, the assembly is performed so that we go from segment $\mathbf{16}_1$ to the next $\mathbf{16}_2$ by traversing a metal track $\mathbf{17}_1$ from one of the lines, then $\mathbf{18}_1$ from the other line, the length of the tracks being roughly equal to double the d spacing between the segments, and the diodes D being assembled in the same direction according to the constant electric path that describes in series the tracks and the segments of a bar; in other words, on the same bar, each diode is assembled successively in the opposite direction.

Finally, in the same line of tracks 17 and 18, each track is gathered with the next one by a balancing resistor R which allows for balancing the voltages when the diodes are reverse poled.

The direct or reverse poling control for the diodes is performed with control wires 11, 12 which are gathered onto a segment of bars as shown above and as clearly depicted in FIG. 3.

In order to obtain phase displacement cells which are comprised of the bar pair B, B' figuring out the elements is made easy if we trace the equivalent electric diagram.

By referring to FIG. 4, we show a diagram that is equivalent to a diode D which is mounted onto a segment 16 that is gathered with the two adjacent metal tracks 17 and 18, when the diode is poled on-line. In the equivalent diagram:

$C_0$ is the decoupling capacity of the metal tracks with the adjacent metal plates p, $C_1$ is the iris or sectioning capacity, between two adjacent metal tracks like $\mathbf{17}_1$, $\mathbf{17}_2$, L is the reactance of the on-line diode D.

The on-line diodes and the iris capacity $C_1$ comprise a resonant circuit which displays as concerns the hyperfrequency wave a susceptance which is null; in other words, there is transparency when the hyperfrequency wave passes almost without phase shift.

In FIG. 5, we showed the equivalent diagram in the other state of the diode, when it is reverse poled. In that instance, the $C_2$ capacity of the diode is added in series with the reactance L.

The equivalent diagram displays a susceptance Y as concerns the hyperfrequency wave.

The differential phase shift which is obtained between the two states is roughly equal to:

$$\Delta\phi = 2 \text{ Arc tg}\left(\frac{Y}{2}\right)$$

Thus we can precisely determine the characteristics of the phase displacement cell which is made up of two such superimposed bars by basically adjusting the width of the metal tracks, their shift from the inner edge of the adjacent metal plates, the type of diode and their step and also the iris capacity, or the width of the slice between two tracks.

The assembly technique is simple, and it relies basically on the printed circuit technique, where the diodes are welded onto the printed wire segments 16. In an example for a device which works inside a frequency band close to 9,300 MHz, we arranged the bars at 6 mm intervals from one another, the first bar supporting the illuminator S, being located at $\lambda/4$ (about 7.5 mm) in front of the short-circuit plane 10. The planes P are implemented by 2 mm thick metal plates that ensure rigidity for the unit, allowing for the drawer assembly of the various bars for the device.

Now we will describe the execution and feed of illuminator S.

Advantageously, it is comprised, like the bars B, of a support substrate plate made of a dielectric material like teflon glass which is for instance identical to the support 15 for the bars B. On that support, the snake line is printed which is made of conductive metal material with a periodicity that is equivalent to the wave length of the processed beam (see FIG. 7).

The feed for the snake line can be performed on a segment as suggested in FIG. 1. In this instance, the undulations are computed so as to have adequate distribution along the entire length of the device (measured parallel to the direction $\vec{H}$). At the end of the snake line, or opposite the segment through which the feed is performed, we place advantageously an end absorbing element which prevents parasitic reflection phenomena.

Figure 6:
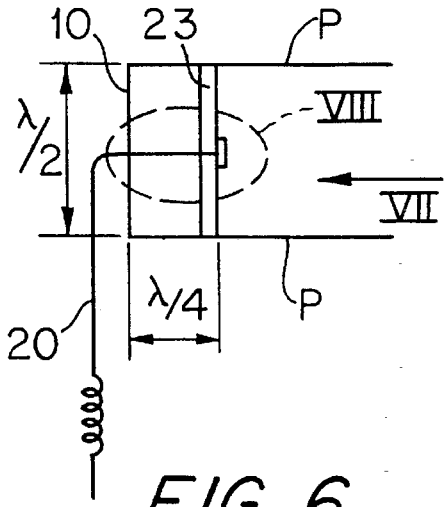
Figure 7:
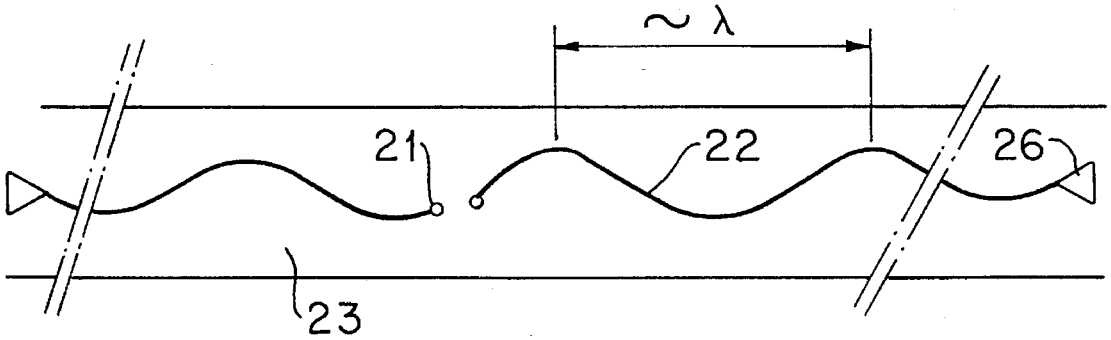
FIG. 7 is a view of FIG. 6 according to arrow VII of that figure.

A preferred solution, like the one illustrated in FIGS. 6 through 8, involves feeding the snake line at its center. In that instance, the feed for each half-snake line is performed through coaxial line 20 of which the central wire 21 is connected to the snake circuit 22 which is printed on the substrate bar 23, of which the sheath 24 is shunted to earth at its crossing in contact with the short-circuit plane 10. In that case, the snake line is symmetrical. At each lateral end of the illuminator, we place an absorbing element 26 in order to avoid parasitic reflection phenomena.

The advantage to a central feed for the illuminator is that it makes it possible to obtain a difference path in the $\vec{H}$ plane by building in only two co-axial outputs at the center of each line, the difference path is then obtained by feeding each of the two half-lines in phase opposition.

One advantage with the illuminator of the snake line type is that it is completely adapted to the width of the channels which is obviously reduced by about $\lambda/2$ of the lens described here, of the general type described in the above mentioned patent 79.27873.

However, other illuminator organs can also be used, even if their assembly and their adaptation must be determined each time.

For instance, by referring to FIG. 9, we can use instead of illuminators S, an illuminator which is made of a rectangular wave guide 30 with lengthwise slits 31 that are directed parallel to the vector $\vec{H}$, of which the width must be smaller than $\lambda/2$ and which will be filled with dielectric material 32 at a suitable constant so as to allow for operation under such reduced width conditions. However, the wave guide must be computed each time according to the characteristics and size of the lens.

Another solution, which is illustrated in FIG. 10, would involve taking a wave guide 33 with a groove 34 and slits 35, the groove allowing the reduction of the width of the guide in order to allow for their insertion inside the channels (Reference: IRE Transactions on antennas and propagation, volume AP-9 January 1961, number 1, Rectangular-Ridge Waveguide Slot Array pp. 102–103). In both instances, precautions must be taken for contact between the lateral walls of the guides and the metal separation planes of the channels.

In FIG. 11, we showed, as an example, a diagram obtained from a device of the type which was described in FIG. 1 and that includes in front illuminator organs of the snake line type which are fed at their center by coaxial cables. The diagram which is provided in the sweep plane (plane E) for a back-off of about 10 degrees is a "total" diagram, both feeds inphase.

FIG. 12 shows at M the total diagram which is obtained inside the plane H, and at N, the difference diagram which is obtained in that same plane when the two symmetrical halves of the illuminators are excited by phase opposition currents; (only the double central feed makes it possible to obtain a diagram in the H plane).

I claim:

1. An electronic sweep device with integrated active lens and source, for the control of a hyperfrequency beam, characterized in that it includes:

a bundling of superimposed channels C, separated one from the other by thin metal planes P which are directed roughly perpendicular to the electric field $\vec{E}$ of the processed beam, a metal short-circuit plane 10 which closes said channels on one side (AR) and connects all of said metal planes plural source means each located inside a different channel close to said metal short-circuit plane (10), phase displacement means comprising a sequence of elements (B, B') which are arranged inside said channels C, said elements located one behind the other in each of said channels C, radioelectric means associated with said source means S in order to transmit and receive, electronic control means associated with said elements of said phase displacement means in order to control each of those elements in an active or passive state.

2. A device according to claim 1, characterized in that said source means are of the snake-line type and are comprised by a printed circuit on a support bar 15 of a dielectric material with a width that is roughly equal to those of the channels C inside which said bar is inserted.

3. A device according to claim 2, characterized in said that source means are fed at one end with a lateral segment of the bundling.

4. A device according to claim 2, characterized in that said source means are fed from their center by one or two coaxial lines (20) of which a main wire (21) is connected to the source means and an outer sheath (24) is shunted to earth and brought across the metal short-circuit plane (10).

5. A device according to claim 1, characterized in that said source means are of the wave guide type (30, 33) with lengthwise slits (31, 35), the width the slits adapted to the channels C by dielectric filling or conforming of the wave guides section.

6. A device according to one of claims 1–5, characterized in that the phase displacement means comprise support bars (15) made of dielectric material with a width that is roughly equal to that of the channels C inside which a bar is inserted, said bars bearing, wire segments (16), printed on them, which are directed when the bars are set up, perpendicular to said separation planes, said segments (16) being brought together in series by metal tracks (17, 18) that are directed perpendicular to said segments and distributed according to two spaced parallel lines, which are close to the segments of the bars, so that a serial path includes one segment ($\mathbf{16}_1$) to the next ($\mathbf{16}_2$) by traversing a metal track ($\mathbf{17}_1$) from one of the lines, then ($\mathbf{18}_1$) from the other, the length of the tracks being roughly equal to double the spacing d between said segments, each segment bearing at least one diode D and all the diodes being assembled in the same direction, by following a constant electric path which describes in series the tracks and the segments of a bar.

7. A device according to claim 6, characterized in that adjacent tracks (17, 18) are connected together by balancing resistors R.

8. A device according to claim 6 or 7, characterized in that said bars (B, B') are assembled like drawers inside grooves located in adjacent separation planes.

9. A device according to claim 6, characterized in that the width of the channels (C) is roughly equal to $\lambda/2$ where A is the wavelength of the beam.

10. A device according to claim 6, characterized in that the source means are located in front of the metal short-circuit plane 10 by about $\lambda/4$ where $\lambda$ is the wavelength of the beam.

* * * * *